US005544711A

United States Patent [19]

Aitken et al.

[11] Patent Number: 5,544,711

[45] Date of Patent: Aug. 13, 1996

[54] MULTIPHASED THROUGH TUBING STRIPGUN

[75] Inventors: John Aitken, Kenney, Tex.; Vittorio L. Oria, Provincia De Buenos Aires, Argentina

[73] Assignee: Texas Petrodet, Inc., Kenney, Tex.

[21] Appl. No.: 382,504

[22] Filed: Feb. 2, 1995

[51] Int. Cl.[6] ..... E21B 43/118

[52] U.S. Cl. ..... 175/4.6; 166/55

[58] Field of Search ..... 175/4.6; 166/55, 166/55.1, 63, 299, 297

[56] References Cited

U.S. PATENT DOCUMENTS

| | | | |
|---|---|---|---|
| 3,965,993 | 6/1976 | Lavigne et al. | 175/4.6 |
| 4,312,273 | 1/1982 | Camp | 175/4.6 X |
| 4,326,462 | 4/1982 | Garcia et al. | 175/4.6 X |
| 4,371,044 | 1/1983 | Willig et al. | 175/4.6 |
| 4,502,550 | 3/1985 | Ibsen | 175/4.6 |
| 4,598,775 | 7/1986 | Vann et al. | 175/4.6 |
| 4,655,138 | 4/1987 | Regalbuto et al. | 175/4.6 X |
| 4,681,037 | 7/1987 | Regalbuto | 175/4.6 X |
| 4,753,301 | 6/1988 | Berry | 175/4.6 |
| 4,881,445 | 11/1989 | Hayes | 175/4.6 X |
| 5,095,999 | 3/1992 | Markel | 175/4.6 |

*Primary Examiner*—Roger J. Schoeppel
*Attorney, Agent, or Firm*—Bush, Moseley, Riddle & Jackson

[57] ABSTRACT

A through tubing stripgun detonating charge assembly for well perforating activities, comprising an elongate explosive resistant retrievable perforating charge support strip having a perforating charge interlocking track situate along the length thereof. A plurality of explosive well casing perforating charges having support elements thereon are connected in supporting and selective positioning interlocking engagement with the perforating charge interlocking track for support of certain ones of a plurality of perforating charges in 180 degree phase oriented and adjustably positionable relation on the perforating charge support strip. The perforating charge strip is also provided with a plurality of perforating charge connectors in spaced relation along the length thereof for support of a plurality of perforating charges in 0 degree phase relation with the perforating charge support strip and in 90 degree phase orientation with each of the 180 degree phased perforating charges. The charge interlocking track may have a dove-tailed cross-sectional configuration for interlocking relation with locking grooves of corresponding relation in certain of the perforating charges. Set screws or charge spacers are used to secure the perforating charges against movement relative to the retrievable support strip.

19 Claims, 4 Drawing Sheets

FIG. 1
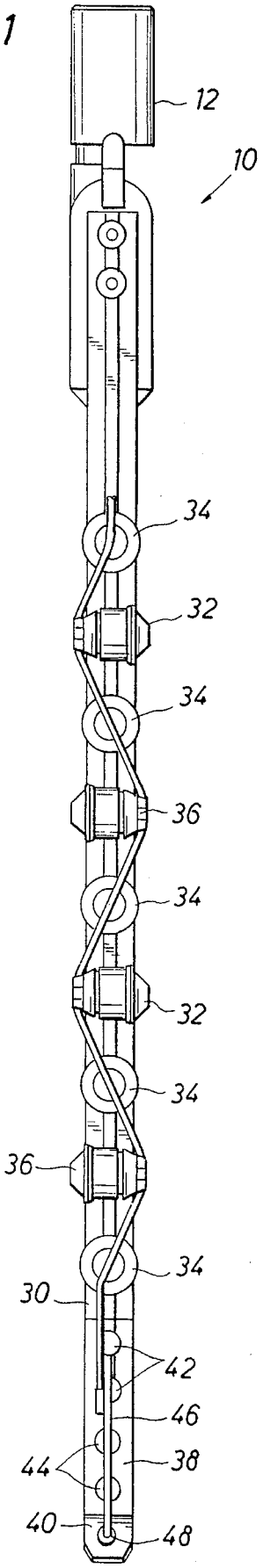
FIG. 2
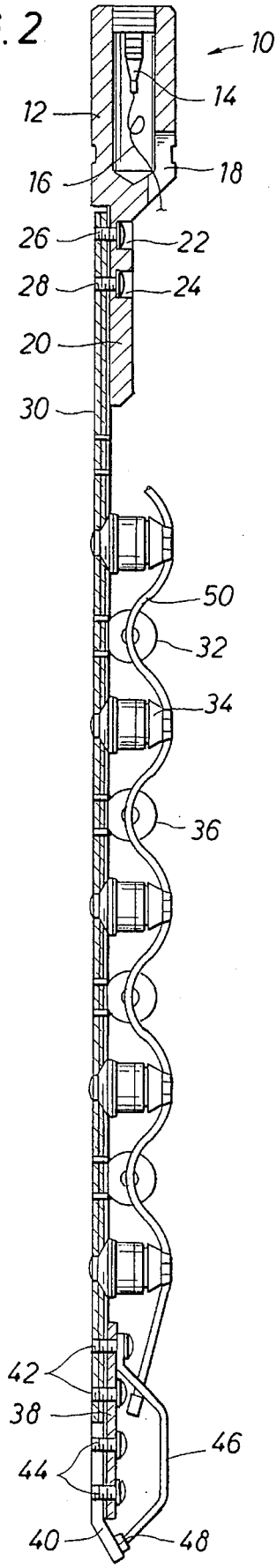
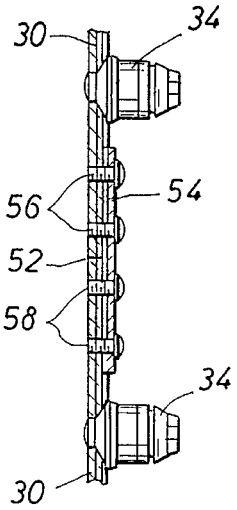
FIG. 3

FIG. 4
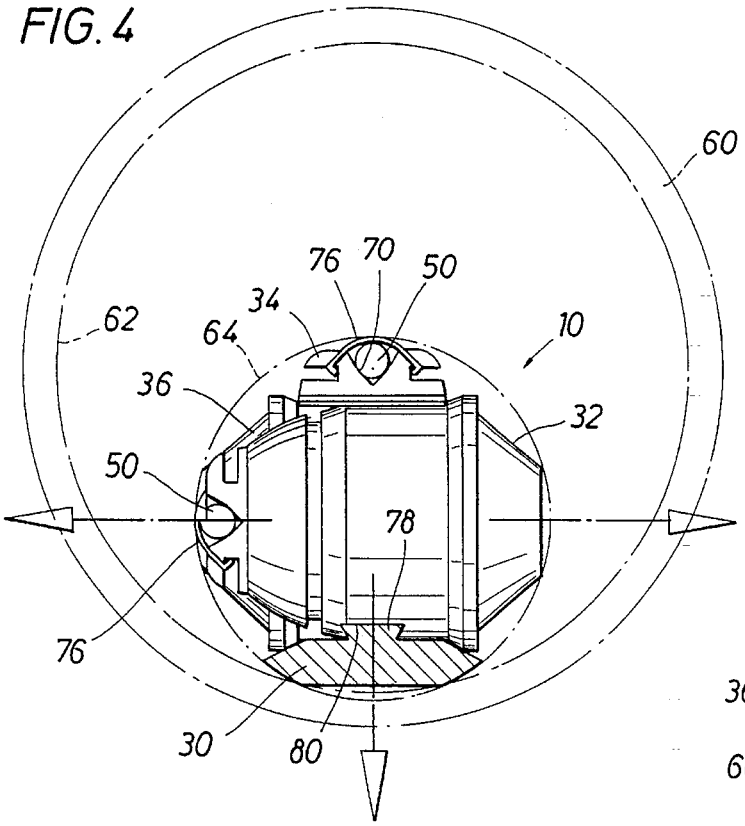
FIG. 5
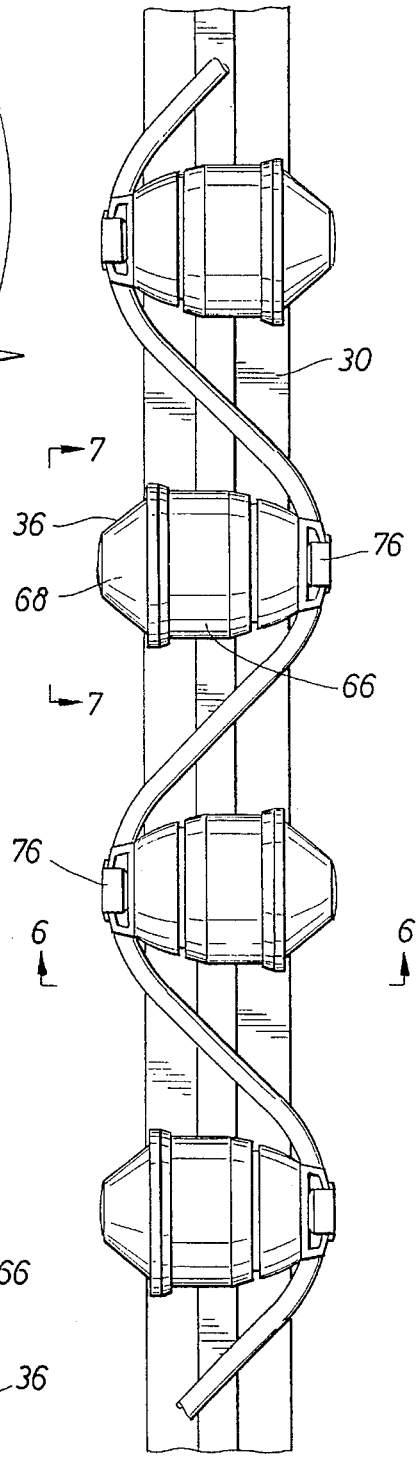
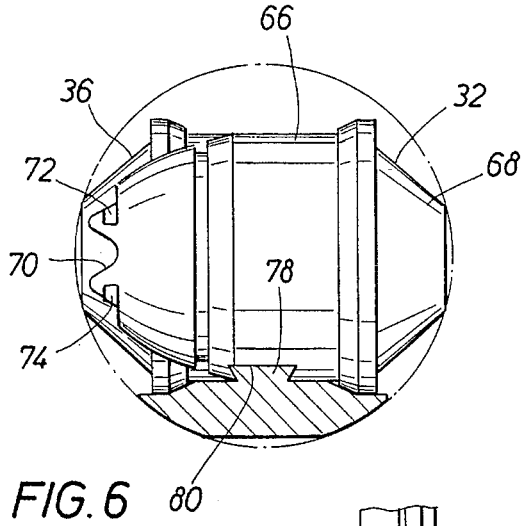
FIG. 6
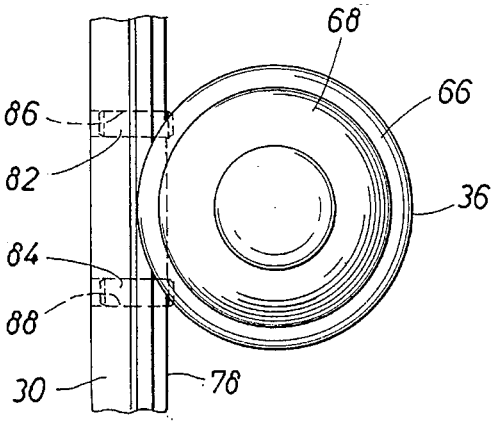
FIG. 7

FIG. 12
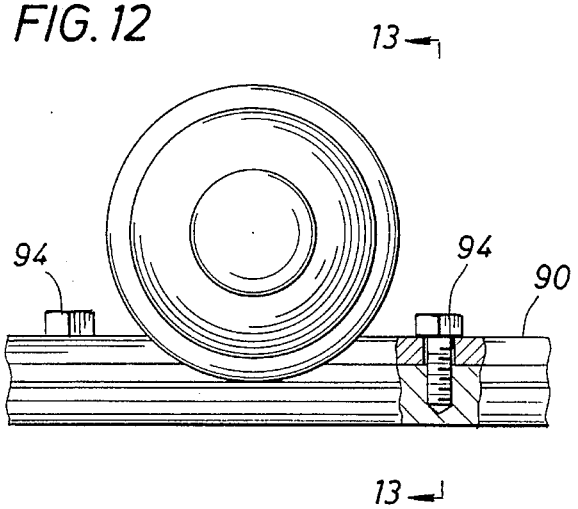
FIG. 13
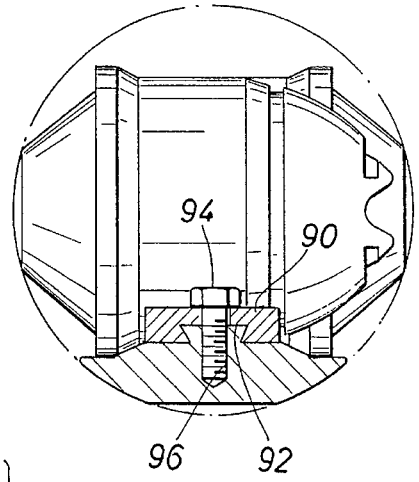
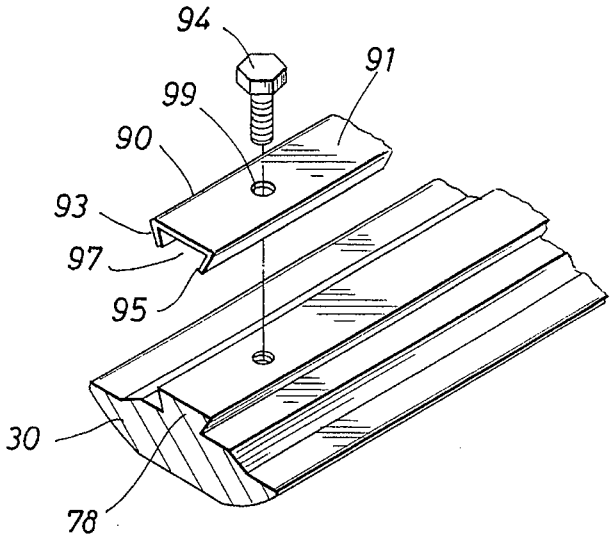
FIG. 14
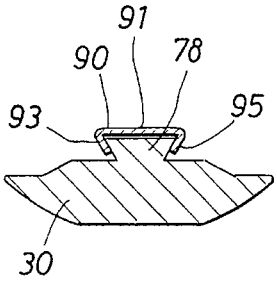
FIG. 15
FIG. 16
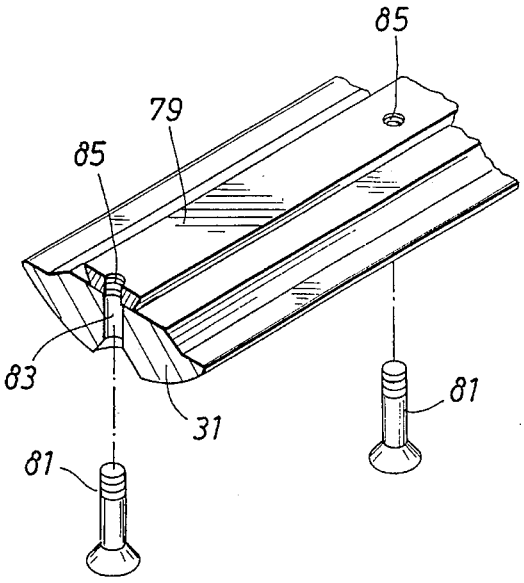

MULTIPHASED THROUGH TUBING STRIPGUN

FIELD OF THE INVENTION

This invention relates generally to perforating guns that are utilized to perforate well casings at the level of production zones to thereby complete the well for production of petroleum products from the production zone, More specifically, the present invention concerns the provision of a two and three phased through tubing stripgun for casing perforation, having encapsulated explosive shaped charges having the capability of selective positioning thereof along the length of a charge carrier strip that remains intact upon detonation of the explosive charges and thereby minimizes the debris that is left in the well bore upon firing of the perforating gun.

BACKGROUND OF THE INVENTION

Perforating guns that are used to perforate well casings after passing through a small diameter production tubing may be made up of individually encapsulated, pressure tight shaped explosive charges which are supported in spaced and specifically oriented positions along the length of a charge carrier section of the perforating gun. "Through tubing" perforating guns are small in diameter relative to the well casing, limiting the explosive powder load that is available for explosive preparation; consequently the penetration and phasing of the perforated holes as well as the amount and type of debris left in the well by the detonated perforating gun are important considerations.

Small diameter "through tubing" perforating guns utilizing encapsulated explosive charges are typically of two general types: in one type of perforating gun the encapsulated explosive charges are linked together as a chain leaving as debris in the well all of the metallic material in the perforating gun. Link-type perforating guns configured in a spiral firing pattern loose efficiency on the particular explosive charge shots that must fire across large diameter fluid filled casings before penetrating the formation surrounding the well casing.

The second general type of "through tubing" perforating gun utilizes in-line firing charges that are mounted on explosive resistant steel carrier strips having the capability of withstanding the explosive detonation of the charges and remaining intact so that the carrier strips may be retrieved after casing perforation activity has been accomplished. For the reason that the steel carrier strips are retrieved after firing of the perforating gun, thus only the debris of the charged cases will remain in the well after the perforating gun has been fired and retrieved. In-line firing stripguns are positioned in the well casing so that all of the charges fire with zero clearance directly into the casing, maximizing the diameter of the perforated holes in the casing and penetration of the explosive energy into the formation, yielding in general higher productivity than wells perforated with spiral phased through tubing type perforating guns. More recently, a through tubing stripgun has been developed, as indicated by U.S. Pat. No. 5,095,999 of Markel. This patent discloses an explosive resistant carrier strip which is configured to orient explosive charges so that the penetration jets of the charges are directed 45° apart. Thus, when this type of stripgun establishes a line of contact with the well casing each line of explosive charges is oriented at plus or minus 22.5° from the line of contact. This type of two phased through tubing perforating gun establishes a 90° shot pattern which offers some advantage over the single phased in-line configuration that is normal with most stripguns.

The need for the carrier strip of a stripgun type through tubing perforating gun to remain intact when the perforating gun is detonated and the small dimension of the tubing through which the stripgun must pass to reach the downhole zone where casing perforation is desired typically limits stripguns to two phase charge orientation as shown by U.S. Pat. No. 5,095,999. If greater than two charge orientation with the type of carrier strip shown by this patent the carrier strip can be severed by the explosive detonation. It is important that the carrier strip be capable of withstanding the explosive detonation so that it can be retrieved from the well, thereby leaving only minute charge case debris to settle to the bottom of the well bore. It is desirable however to provide a through tubing stripgun capability enabling one, two or three phased charge orientation and yet insuring that the carrier strip of the stripgun will withstand the explosive detonation so that it may be retrieved from the well. It is also desirable to provide a through tubing stripgun that is provided with the capability of selectively orienting the location of the shaped charges along the length of the stripgun so that field personnel may select both the phase orientation and the vertical charge spacing as appropriate to the character of casing perforation that is desired.

SUMMARY OF THE INVENTION

It is a principal feature of the present invention to provide a through tubing type stripgun for achieving well perforation activities and by providing an explosive carrier strip that is capable of withstanding explosive detonation of the perforating charges so that it may be retrieved from the well along with other portions of the perforating gun.

It is a further feature of this invention to provide a novel multiphased through tubing stripgun which permits selective phase orientation of the perforating charges as desired for specific casing perforation and which also permits selective vertical spacing of the shaped charges relative to the carrier strip so that the well completion shots may be selectively oriented from the standpoint of both angular phase and vertical spacing as desired at the time of well perforation.

It is an even further feature of this invention to provide a novel through tubing type multiphased stripgun having undercut slots such as dove-tail slots along the length thereof and providing shaped charge mounting basis that are received by the undercut slots to thereby permit vertical orientation of the shaped charges at any selected location along the length of the carrier strip.

It is another feature of this invention to provide a novel through tubing stripgun wherein simple and efficient stops are utilized to secure the shaped charges at selected positions along the length of the carrier strip.

It is an even further feature of this invention to provide a novel through tubing type stripgun assembly wherein selected spacing of perforated charges along the length of the stripgun may be stabilized by means of track mounted spacers that are positioned between the explosive charges.

It is another feature of this invention to provide a novel multiphased through tubing stripgun having an explosive resistant carrier strip and having explosive charge mounting basis that may be reversibly oriented relative to the track of the carrier strip so as to permit selective orientation of the explosive charges relative to the carrier strip.

Briefly a multiphased through tubing stripgun constructed in accordance with the present invention will comprise an elongate explosive charge carrier strip of a length that is suitable for the casing perforation activity under consideration. The elongate carrier strip will be of sufficient cross-sectional dimension to effectively withstand detonation of the shaped charges so that it will remain intact when the charges are detonated and may be retrieved from the well along with other casing perforation equipment. The elongate carrier strip will define a track extending along the length thereof and the casings or mounting bases of the sealed shaped charges will have portions interfitting with the elongate track and serving to retain the shaped charges at desired phase orientation. The elongate carrier strip may also define apertures at spaced locations along the length thereof thereby committing specific charges of the shaped charge array to be oriented in a manner to project the explosive jets thereof through the apertures in the carrier strip so that these explosive jets will penetrate the tubing and casing and project well into the formation surrounding the well casing.

If desired, the elongate track means of the carrier strip may be defined by a dovetail projection or dove-tail groove. In this case the sealed shaped charges will be provided with corresponding projections or grooves thereby enabling them to be positioned at selected locations along the length of the carrier strip simply by moving them along the length of the track. When the explosive charges are properly positioned relative to the length of the carrier strip the shaped charges may be locked in place by means of set screws or may be retained in position by spacers that are also received by the track of the carrier strip. Thus, it seen that the through tubing stripgun of the present invention will have the capability of one, two or three phased orientation of the shaped charges and will have the capability of selective vertical positioning of the shaped charges along the length of the carrier strip.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

In the drawings:

FIG. 1 is an elevational view of a multiphased through tubing stripgun constructed in accordance with the present invention.

FIG. 2 is a side elevational view of the multiphased through tubing stripgun of FIG. 1 with upper and lower portions thereof shown by way of sectional view.

FIG. 3 is a partial elevational view of interconnected multiphased through tubing stripguns and specifically showing the connection mechanism thereof for joining stripgun sections end to end.

FIG. 4 is a cross-sectional illustration of a well casing and tubing shown in broken lines and in full lines showing a multiphased through tubing stripgun constructed in accordance with the present invention being situate within the tubing and in position for perforation of the well casing.

FIG. 5 is a partial elevational view of a dual, 180° phased through tubing stripgun constructed in accordance with the present invention.

FIG. 6 is a sectional view taken along line 6—6 of FIG. 5.

FIG. 7 is an elevational view taken along line 7—7 of FIG. 5.

FIG. 12 is a side elevational view of a multiphased stripgun representing an alternative embodiment of the present invention having spacer elements for maintaining selective positioning of the explosive perforating charges.

FIG. 13 is a sectional view taken along line 13—13 of FIG. 12.

FIG. 14 is an exploded isometric illustration of a portion of a carrier strip and a portion of a charge spacer and bolt assembly representing an alternative embodiment of this invention.

FIG. 15 is a sectional view of the assembled carrier strip and charge spacer strip of FIG. 14.

FIG. 16 is an exploded partial isometric illustration of a carrier strip an dove-tailed projection assembly representing another embodiment of this invention.

DETAILED DESCRIPTION OF PREFERRED EMBODIMENT

Figure 9:
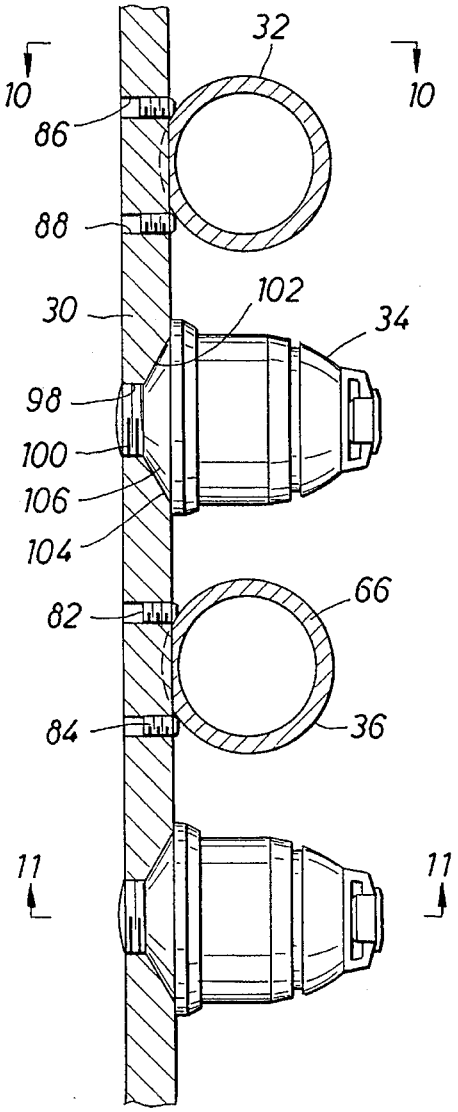
FIG. 9 is a sectional view of the elongate charge support strip taken along line 9—9 of FIG. 8 and showing a certain shaped charges thereof by way of full line.
Figure 8:
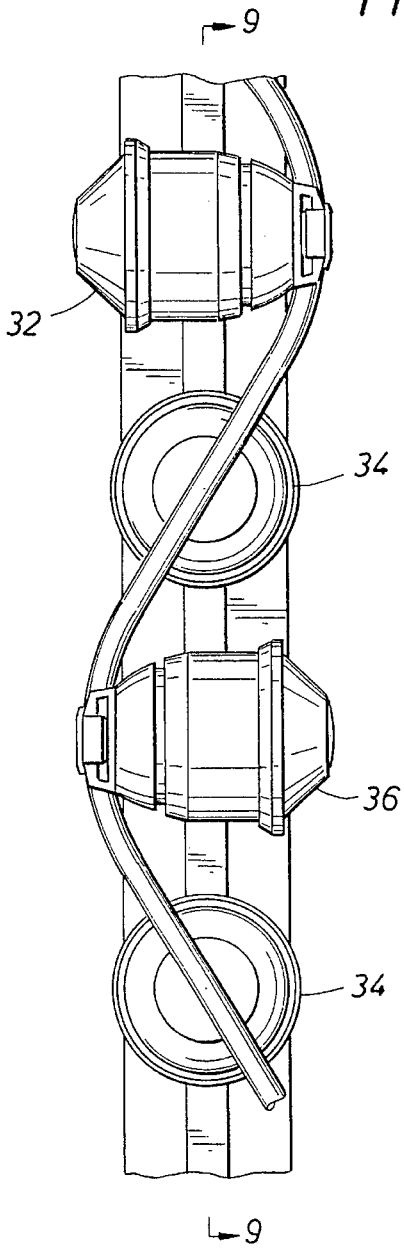
FIG. 8 is a partial elevational view of the multiphased through tubing stripgun of the present invention showing three phased orientation of the respective sealed shaped charges thereof.

Referring now to the drawings and first to FIGS. 1–3 a through tubing type multiphased stripgun for well casing perforation is shown generally at 10 and incorporates a perforator head 12 which is adapted such as by threads for connection to a suitable running tool such as a wireline running tool or any other component of a perforating gun system. The perforating head is provided with an elongate coupling extension 20 having openings 22 and 24 therein for receiving bolts or screws 26 and 28 that serve to connect an elongate explosive carrier strip 30 to the coupling extension 20. The carrier strip 30 is adapted as will be explained herein below for supporting a plurality of sealed shaped charge elements such as shown at 32, 34 and 36 so that the shaped charges are oriented for multiphased projection of the explosive jets thereof through the well casing and into the surrounding formation. With regard to FIGS. 1 and 2 it should be noted that the explosive charges 32 and 36 have phase orientation of 180° with respect to one another. The explosive charge 34 has a phase orientation of 90° with respect to each of the explosive charges 32 and 36.

At the lower extremity of the carrier strip 30 there is provided a coupling plate 38 which, as shown in FIGS. 1 and 2, provides for connection of a lower guide element 40 to the lower end of the carrier strip. The coupling plate 38 is connected to the carrier strip by bolts 42 and connected by bolts 44 to the guide nose 40. A guide element 46 is secured in fixed relation to the coupling plate by the upper bolt 42 and is secured at its lower end to the guide nose 40 by means of guide connector 48. The guide element 46 will traverse the internal surface of the tubing thus causing the carrier strip 30 to be oriented in engagement with the tubing.

A detonating cord 50 extends along the length of the perforating gun and is operatively coupled to each of the shaped charges thereof. The detonating cord, when detonated, causes simultaneous initiation of each of the shaped charges.

As shown in FIG. 3, it may be appropriate to interconnect two or more carrier strips 30 end to end so as to insure that the casing section spanning the formation of interest is perforated along its entire length. As shown in FIG. 3 carrier strip sections 30 are oriented in substantially abutting relation as shown at 52 each of the carrier strips will define a pair of bolt holes at the respective ends thereof which are positioned in registry with appropriate bolt holes defined in a coupling plate 54. Which, if desired, may be identical with the coupling plate 38. Bolts 56 and 58 are employed to secure the respective carrier strips to the coupling plate. The length of detonating cord will simply extend from the shaped charges of the upper carrier strip to the shaped charges of the lower carrier strip. All of the shaped charges will be simultaneously initiated by detonation of the detonating cord.

Referring now to FIG. 4 there is provided a cross-sectional illustration of a well casing shown in broken line at 60 and having the through tubing stripgun 10 located therein with the charge support strip 30 in engagement with the internal wall surface 62 of the well casing. The circular broken line 64 is representative of the maximum cross-sectional diameter of the stripgun which enables it to traverse through a production tubing within the casing to reach the production interval of the surrounding formation.

As shown in FIGS. 4–7 each of the sealed shaped charges 32, 34 and 36 define a charge body or casing 66 which is of generally cylindrical configuration and which is provided with a domed type charge cap 68 of generally frusto-conical configuration and which is secured in sealed relation to the charge body 66. Internally, the charge body is of substantially cylindrical configuration as is evident from FIG. 9. The charge body, at the end thereof opposite the domed type charge cap 68 defines a detonating cord groove 70 which may be of smoothly curved configuration as shown in FIG. 6. Adjacent the detonating cord groove 70 the charge body 66 defines opposed recesses 72 and 74 which receive respective ends of a retainer clip 76 that secures the detonating cord 50 within its groove 70. The retainer clips 76 also function as guide elements which may contact to the internal wall surface of the tubing string as the stripgun is moved to its casing perforation depth. These clips also provide standoff between the internal wall surface of the tubing string and the detonating cord so as to protect the detonating cord against erosion as the stripgun traverses the tubing string.

It is desirable to provide for adequately securing the casing perforation charges at desired locations along the length of the carrier strip 30 and to insure against inadvertent movement of the perforation charges as the stripgun is run through the tubing string. In the case of the three phased casing perforation embodiment of FIGS. 1 and 2 a number of the shaped charges, such as the charges 34 are intended to be connected to the carrier strip at specific locations along the length thereof. Though the other shaped charges 32 and 36 may also be specifically located along the length of the carrier strip, in practice they may be shifted along the length of the stripgun to positions other than as shown in FIGS. 1 and 2. In the case of the dual 180° phased stripgun of FIG. 5, all of the shaped charges thereof may be selectively positioned along the length of the carrier strip 30. These desirable features are effectively provided by defining an elongate track along the length of the carrier strip and by providing at least some of the shaped charges with the capability of adequate support and selective positioning relative to the guide track. As shown in FIGS. 4–11 the guide track of the carrier strip may conveniently take the form of a dove-tailed projection 78 which is oriented substantially centrally of the carrier strip. Correspondingly, the generally cylindrical charge bodies of certain of the shaped charges, i.e. shaped charges 32 and 36 are configured to define dove-tailed slots 80 which receive the elongate dove-tailed projection 78 of the carrier strip and thus establish a mechanically interlocked relation with each of the charge bodies of shaped charges 32 and 36. The interlocked dove-tailed connection between the carrier strip 30 and the body structure of the shaped charges provides for precise lateral orientation of the shaped charges so that the charge jet direction thereof is oriented at a phase of 180° as shown in FIG. 4.

As shown in FIG. 16 a carrier strip 31 may be provided to which may be connected a track strip 79 which may be of dove-tailed cross-sectional configuration as shown or which may be of any other cross-sectional configuration as suits the intended purpose of the user or which is appropriate for the well completion activity that is intended. For example the dove-tailed charge mounting strip 79 may have a desired angular orientation with respect to the carrier strip 31 to achieve desired phase orientation of the charges 32 and 36 with respect to the phase orientation of the charges 34. Selected phase orientation of the charges may thus be achieved simply by attachment of mounting strips having selected angular orientation with respect to the carrier strip. The mounting strip 79 may be secured to the carrier strip by screws or bolts 81 which extend through holes 83 of the carrier strip and are received by threaded holes 85 of the mounting strip. If desired the screws or bolts 81 may also enter threaded openings of the explosive charge bodies to also secure the charges against axial movement relative to the mounting strip and carrier strip.

While explosive charges 34 fire directly through the threaded charge attachment openings of the carrier strip other charges, such as charges 32 and 36 may assume other angular displacements than the 90° phase displacement from the charge 34 orientation that is shown in FIGS. 1 and 2, resulting in other phase orientations that are suitable for some well conditions. This is accomplished simply by controlling the angle of the charge connection system of the charges 32 and 36. For example, the dove-tailed slot 80 may be oriented with respect to the charge body 66 such that the angular phase orientation of the charge will be angularly offset from that of charge 34 by a predetermined angle other than 90°. For example charges 32 and 36 may establish phase angles of plus and minus 45° with respect to charge 34 simply by orienting the angular relation of the dove-tailed slot in the charge body to define such phase orientation. Obviously the elongate track may also be angularly oriented in controlled manner relative to the carrier strip to achieve desired phase orientation of the various charges.

Figure 10:
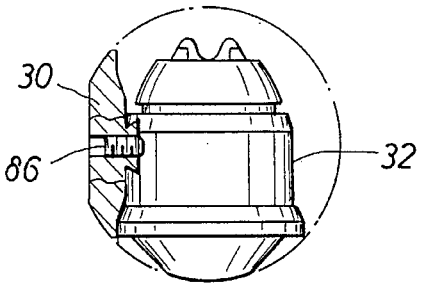
FIG. 10 is a sectional view taken along line 10—10 of FIG. 9 and showing the explosive charge case by way of full line.

It will be desirable to secure the shaped charges 32 and 36 against longitudinal movement relative to the carrier strip. As shown in FIGS. 7, 9 and 10 one suitable means for locking the respective shaped charges against inadvertent movement along the length of the carrier strip may comprise a pair of set screws 82 and 84 which are received within internally threaded openings 86 and 88, respectively. These set screws, when threaded through the carrier strip will project beyond the dove-tailed projection 78 and will engage respective sides of the charge bodies 66 as shown in FIG. 9. If desired, the set screw holes 86 and 88 may be formed in the carrier strip during manufacturing thereof so that the 180° phased shaped charges will be located relative to the carrier strip by the manufacturing operation. In the alternative, the set screw holes may be drilled and tapped in the field just prior to running of the perforation gun. Thus, especially in the case of the dual phased stripgun of FIG. 5 the shaped charges may be individually located relative to the length of the carrier strip simply by appropriate positioning of the threaded set screw holes.

As shown in FIGS. 14 and 15 the spacer strips 90 may be composed of stamped or formed sheet material such as metal having a generally planar body section 91 and angularly oriented edge flanges 93 and 95 which define an internal receptacle 97 within which is received the dove-tailed projection 78. The mounting bolts 94 are then extended through apertures 99 to secure the spacer elements to the carrier strip 30. The sheet material spacer elements can be of quite inexpensive manufacture without detracting from the effectiveness of the strip charge assembly.

Figure 11:
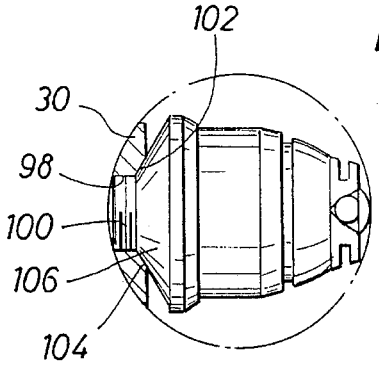
FIG. 11 is a sectional view taken along line 11—11 of FIG. 9 and also showing the explosive charge case by way of full line.

As an alternative to set screw retention of the shaped charges as shown in FIGS. 7, 10 and 11 charge spacer elements may be provided having dove-tail grooves that receive the dove-tail projection 78 of the carrier strip. These spacer elements may interposed between and in contact with the respective shaped charges so as to secure them in the selected position. The spacer strips may be of various selected length so as to achieve selected positioning of the shaped charges relative to the carrier strip. If desired, the spacer elements may be secured by bolts or screws 94 to the carrier strip.

It may also be desirable to fix the perforating charges 34 so that the explosive jets thereof will be oriented 90° with respect to the phases of the perforating charges 32 and 36. As shown in FIGS. 9 and 11 the carrier strip 30 will be machined to define threaded openings such as shown at 98, which receive the external threads of a threaded charge cap 100. The carrier strips are further machined to define beveled recesses 102 that correspond to the configuration of the external tapered surface 104 of the end cap 106. Thus, perforating charges 34 will be maintained in threaded assembly with the carrier strip 30 as shown particularly in FIGS. 9 and 11 while the perforating charges 32 and 36 will be secured to the carrier strip by the interlocking track assembly such as the dove-tail projection and groove assembly shown in FIGS. 4–7.

It is to be borne in mind that although the invention is described herein particularly through the provision of a dove-tail type track interconnection between the perforating charges and the carrier strip it is not intended to limit the spirit and scope of the invention to this particular structure. It should be borne in mind that any suitable interengaging track arrangement that is capable of being employed to secure the perforating charges in selectively positioned assembly with the elongate carrier strip may be employed within the spirit and scope of this invention.

Various modifications and alterations in the described methods and apparatus will be apparent to those skilled in the art of the foregoing description which does not depart from the spirit of the invention. For this reason, such changes are desired to be included in the appended claims. The appended claims recite the only limitation to the present invention. The descriptive manner which is employed for setting forth the embodiments should be interpreted as illustrative but not limitative.

What is claimed is:

1. A through tubing stripgun well casing perforating charge assembly for well casing perforating activities, comprising:

(a) an elongate explosive resistant retrievable perforating charge support strip having an elongate external perforating charge interlocking track situate along the length thereof; and (b) a plurality of sealed explosive well casing perforating charges each having an externally exposed interlocking mount thereon for establishing interlocking engagement with said elongate perforating charge interlocking track for support of said perforating charges externally of said perforating charge support strip and in mechanically interlocked assembly with said elongate perforating charge interlocking track and for orienting said perforating charges in selective phase orientation with respect to said elongate explosive resistant retrievable perforating charge support strip.

2. The through tubing stripgun well casing perforating charge assembly of claim 1, wherein:

said perforating charge interlocking track and said externally exposed interlocking mount of said perforating charges being oriented for permitting selective 180 degrees phase orientation of said plurality of well casing perforating charges relative to said elongate explosive resistant retrievable perforating charge support strip.

3. The through tubing stripgun well casing perforating charge assembly of claim 1, wherein:

(a) said elongate explosive resistant retrievable perforating charge support strip defining a plurality of charge connectors that are disposed in spaced relation along the length thereof;

(b) at least some of said well casing perforating charges are supported in fixed relation with said elongate explosive resistant retrievable perforating charge support strip by respective charge connectors and are oriented for 0 degrees phase orientation thereof relative to said elongate explosive resistant perforating charge support strip; and (c) said selective phase orientation are plus 90 degrees and minus 90 degrees with respect to said 0 degrees phase orientation.

4. The through tubing stripgun well casing perforating charge assembly of claim 3, wherein:

(a) said charge connectors comprise threaded openings being defined in spaced location along the length of said explosive resistant retrievable perforating charge support strip: and (b) said at least some of said well casing perforating charges having externally threaded charge caps being receivable in threaded connection with said threaded openings.

5. The through tubing stripgun well casing perforating charge assembly of claim 1, wherein said elongate external perforating charge interlocking track comprises:

(a) an external mounting track configuration having opposed undercut shoulders being defined substantially along the entire length of said elongate charge support strip and defining a portion of the external surface area thereof; and (b) at least some of said well perforation charges having charge bodies defining an external mounting slot configuration having mating interlocking engagement with said external mounting track configuration of said elongate explosive resistant charge support strip; and (c) means securing said at least some of said well perforation charges against longitudinal movement relative to said external mounting track configuration.

6. The through tubing stripgun well casing perforating charge assembly of claim 5, wherein said external mounting track configuration comprises:

(a) a mounting ridge extending substantially along the entire length of said elongate explosive resistant charge support strip and defining said opposed undercut shoulders; and (b) said charge bodies of at least some of said perforating charges having mounting grooves therein of a configuration for mechanically interlocking engagement with said opposed undercut shoulders of said mounting ridge.

7. A through tubing stripgun well casing perforating charge assembly for well casing perforating activities, comprising:

(a) an elongate explosive resistant retrievable perforating charge support strip having an external perforating charge interlocking track of dove-tailed cross-sectional configuration situate along the length thereof;

(b) a plurality of sealed explosive well casing perforating charges each defining an external dove-tailed mounting slot establishing a mechanically interlocked relation with said external perforating charge interlocking track; and (c) means securing said mechanically interlocked perforating charges against longitudinal movement relative to said external perforating charge interlocking track.

8. The through tubing stripgun well casing perforating charge assembly of claim 7, wherein:

said securing means comprising lock means engaging both said elongate charge support strip and said perforating charges and establishing locking engagement with respective ones of said perforating charges.

9. The through tubing stripgun well casing perforating charge assembly of claim 8, wherein:

said lock means comprising locking elements extending through said elongate perforating charge support strip and establishing locking engagement with said explosive well casing perforating charges.

10. The through tubing stripgun well casing perforating charge assembly of claim 7, wherein:

said securing means being a plurality of charge spacer elements being received in interlocking assembly with said dove-tailed mounting ridge and securing said explosive charges against longitudinal movement relative to said dove-tailed mounting ridge.

11. The through tubing stripgun well casing perforating charge assembly of claim 7, wherein:

said securing means being screw elements extending through said elongate charge support strip and having locking engagement with opposed side portions of respective perforating charges.

12. The through tubing stripgun well casing perforating charge assembly of claim 1, wherein said perforating charge interlocking track comprises:

(a) an external mounting track defining at least one undercut retainer shoulder being situate along the length of said elongate perforating charge support strip; and (b) said well perforating charges having externally exposed mounting slots establishing mechanical interlocking relation with said undercut retainer shoulder to secure said well perforating charges in mechanically interlocked relation with said elongate perforating charge support strip.

13. The through tubing stripgun well casing perforating charge assembly of claim 12, wherein said external mounting track comprises:

(a) at least one elongate profiled undercut slot being defined in said elongate charge support strip; and (b) said well perforating charges each having a sealed charge body defining a locking retainer of mating cross-sectional configuration with said elongate profiled undercut slot and being received in interlocking relation within said elongate profiled undercut slot.

14. The through tubing stripgun well casing perforating charge assembly of claim 13, further comprising:

means locking said locking retainer of each of said well casing perforating charges at a selected location along the length of said elongate profiled undercut slot.

15. The through tubing stripgun well casing perforating charge assembly of claim 14, wherein said locking means comprises:

locking elements projecting from said elongate charge support strip and engaging charge body of a respective perforating charge for securing said charge body in substantially immovable relation with said elongate charge support strip.

16. The through tubing stripgun well casing perforating charge assembly of claim 1, wherein:

(a) said elongate charge support strip defines an axis of symmetry;

(b) said perforating charge interlocking track being at least one elongate profiled undercut slot situate along substantially the entire length of said elongate charge support strip and being exposed externally thereof; and (c) said well perforating charges each having an externally exposed interlocking element thereon being engagable in interlocked relation within said profiled undercut slot and being orientable at selected phase angles of plus and minus 90 degrees with respect to said axis of symmetry.

17. A through tubing stripgun well casing perforating charge assembly for well casing perforating activities, comprising:

(a) an elongate explosive resistant retrievable perforating charge support strip having an elongate externally exposed perforating charge interlocking track situate along the length thereof and having a plurality of perforating charge connector receptacles located in spaced relation along the length thereof;

(b) a first plurality of explosive well casing perforating charges each having an interlocking support mount exposed externally thereof and being connected in supporting and selective positioning interlocking engagement with said perforating charge interlocking track for support of said perforating charges in mechanically interlocked assembly with said elongate explosive resistant retrievable perforating charge support strip and in selective 180 degree phase orientation thereof relative to said elongate explosive resistant retrievable perforating charge support strip; and (c) a second plurality of explosive well casing perforating charges each having a connector cap thereon being received in fixed relation by respective perforating charge receptacles and being oriented in substantially 0 degrees phase orientation with said explosive resistant retrievable elongate perforating charge support strip and in substantially 90 degrees relative phase orientation with each of said first plurality of 180 degrees phase oriented explosive well casing perforating charges such that some of said first plurality of explosive well casing perforating charges are oriented in plus 90 degrees phase orientation with said second plurality of explosive well casing perforating charges and others of said first plurality of explosive well casing perforating charges are oriented in minus 90 degrees phase orientation with said second plurality of explosive well casing perforating charges.

18. The through tubing stripgun well casing perforating charge assembly of claim 17, wherein:

said elongate externally exposed interlocking track and said interlocking support mounts of said explosive well casing perforating charges being symmetrical and permitting selective 180 degrees phase orientation of said first plurality of explosive well casing perforating charges relative to said elongate explosive resistant retrievable perforating charge support strip.

19. The through tubing stripgun well casing perforating charge assembly of claim 17, wherein:

each of said explosive well casing perforating charges having an interlocking support mount for interlocking assembly with said elongate externally exposed perforating charge support track and a connector cap for fixed assembly with said perforating charge receptacles thus permitting selective mounting of said perforation charges to define three phase orientation of respective perforating charges of 0 degrees, plus 90 degrees and minus 90 degrees relative to said perforating charge support strip.

* * * * *